US006072976A

United States Patent [19]

Kuriyama et al.

[11] Patent Number: 6,072,976

[45] Date of Patent: Jun. 6, 2000

[54] INTERMEDIATE TRANSFER MEMBER FOR ELECTROSTATIC RECORDING

[75] Inventors: Shigeo Kuriyama, Yokohama; Takahiro Sakami, Kanagawa-ken; Yoshikazu Ueno, Yokohama; Takayuki Mochizuki, Yokohama; Toshiaki Shimomura, Yokohama; Itaru Kurimoto, Fujisawa; Hiroshi Murata, Komae, all of Japan

[73] Assignee: Bridgestone Corporation, Tokyo, Japan

[21] Appl. No.: 08/989,879

[22] Filed: Dec. 12, 1997

[30] Foreign Application Priority Data

| | | | |
|---|---|---|---|
| Dec. 17, 1996 | [JP] | Japan | 8-353633 |
| Mar. 25, 1997 | [JP] | Japan | 9-91658 |
| Apr. 16, 1997 | [JP] | Japan | 9-114279 |
| Oct. 7, 1997 | [JP] | Japan | 9-290451 |
| Nov. 7, 1997 | [JP] | Japan | 9-322047 |

[51] Int. Cl.[7] ..... G03G 15/01; G03G 15/16

[52] U.S. Cl. ..... 399/302; 399/308; 428/909

[58] Field of Search ..... 399/302, 308; 428/909

[56] References Cited

U.S. PATENT DOCUMENTS

| | | | |
|---|---|---|---|
| 5,089,856 | 2/1992 | Landa et al. | 399/308 |
| 5,754,931 | 5/1998 | Castelli et al. | 399/308 X |

*Primary Examiner*—William J. Royer

*Attorney, Agent, or Firm*—Sughrue, Mion, Zinn, Macpeak & Seas, PLLC

[57] ABSTRACT

Disclosed is an intermediate transfer member used for printing by an intermediate transfer method in an electrostatic recording process, which is capable of preventing adhesion and fusion of a tone on the surface of the intermediate transfer member as mush as possible, thereby obtaining a high quality image without dimming, positional offset and unevenness of color. The intermediate transfer member is disposed between an image forming body and a recording medium for allowing a toner image formed on the surface of the image forming body to be once transferred and held on the surface of the intermediate transfer member and to be then transferred on the recording medium. The intermediate transfer member includes a fabric layer having a structure of one or more layers; and an elastic layer laminated on either or each of surfaces of the fabric layer.

19 Claims, 8 Drawing Sheets

INTERMEDIATE TRANSFER MEMBER FOR ELECTROSTATIC RECORDING

BACKGROUND OF THE INVENTION

The present invention relates to an intermediate transfer member used for an electrostatic recording process in an electrophotographic device or electrostatic recording device such as a copying machine or printer. A toner image, which is formed by supplying a developer on the surface of an image forming body such as a latent image support holding an electrostatic latent image, is once transferred and held on the surface of the intermediate transfer body and is then transferred on a recording medium such as a paper sheet. The invention also relates to a manufacturing method of an intermediate transfer belt as one example of the intermediate transfer body and to an intermediate transfer device using the intermediate transfer body.

In an electrostatic recording process using a copying machine, printer or the like, there has been adopted a printing method including the steps of uniformly electrifying the surface of a photosensitive body (latent image support), forming an electrostatic latent image on the photosensitive body by projecting light from an optical system on the photosensitive body to erase electrification of a portion where the light is irradiated, supplying a toner to the electrostatic latent image to form a toner image by electrostatic adhesion of the toner, and transferring the toner image on a recording medium such as a paper sheet, OHP, or photographic paper.

In color printing using a color printer or a color copying machine, the above printing process is basically adopted. However, for color printing, since a color tone is reproduced using four kinds of toners corresponding to four colors (magenta, yellow, cyan and black), there are required steps of obtaining a necessary color tone by superimposing these toners at a specific ratio. To effectively achieve these steps, there have been proposed various methods.

As a first method, there is known a multiple developing method in which, to visualize an electrostatic latent image formed on a photosensitive body by supplying toners, development is performed by a manner similar to that for monochromatic printing, that is, by sequentially superimposing toners of four colors (magenta, yellow, cyan and black) to form a color toner image on the photosensitive body. This method allows the printing apparatus to be made relatively compact; however, it is disadvantageous in that control of color gradation is very difficult and thereby a high quality image cannot be obtained.

As a second method, there is known a tandem method using four photosensitive drums aligned in line. In this method, four latent images formed on these photosensitive drums are developed using toners of four colors (magenta, yellow, cyan and black) to form four toner images (magenta toner image, yellow toner image, cyan toner image, and black toner image), and the toner images are sequentially transferred on a recording medium such as a paper sheet in a superimposing manner, thereby reproducing a color image thereon. This method is advantageous in that a desirable image can be obtained; however, it is disadvantageous in that the printing apparatus has the four photosensitive drums aligned in line, each being additionally provided with an electrifying mechanism and a developing mechanism and thereby it is enlarged in size and also increased in cost.

As a third method, there is known a transfer drum method using a transfer drum around which a recording medium such as a paper sheet is wound. Such a transfer drum revolves on its axis four times, and toner images of four colors (magenta, yellow, cyan, and black) formed on photosensitive bodies are sequentially transferred on the recording medium for each revolution of the transfer drum, to thereby reproduce a color image thereon. This method is advantageous in that a relatively high quality image can be obtained; however, it is disadvantageous in that there is a difficulty in winding a thick medium such as a post card, that is, there is a limitation to the kind of the recording medium.

In addition to the above multiple developing method, tandem method, and transfer drum method, there has been proposed an intermediate transfer method for ensuring a high quality image without enlargement of the size of the apparatus and also without limitation to the kind of the recording medium.

To be more specific, the intermediate transfer method is carried out by forming toner images of four colors (magenta, yellow, cyan, and black) on four photosensitive bodies disposed around an intermediate transfer member such as a drum or a belt, sequentially transferring the four toner images from the four photosensitive bodies onto the surface of the intermediate transfer body to form a color image on the intermediate transfer member, and transferring the color image on a recording medium such as a paper sheet. In this method, since color gradation is adjusted by superimposing toner images of four colors, a high quality image can be obtained. Also, since the photosensitive bodies are not required to be aligned in line like the tandem method, the size of the apparatus is not enlarged. Further, since a recording medium is not required to be wound around a drum, there is no limitation to the kind of the recording medium.

Such an image forming apparatus for forming a color image by the intermediate transfer method is shown in FIGS. 1 and 2, wherein FIG. 1 shows a type using a belt-shaped intermediate transfer member, and FIG. 2 shows a type using a drum-shaped intermediate transfer member.

Referring to FIGS. 1 and 2, reference numeral 1 indicates a drum-shaped photosensitive body which revolves in the direction shown by an arrow. The photosensitive body 1 is electrified by a primary electrifier 2, and is subjected to image exposure 3 for erasing electrification of an exposed portion. Thus, an electrostatic latent image corresponding to a first color component is formed on the photosensitive body 1. The electrostatic latent image is then developed with a magenta toner M as a first color toner using a developer 41 to form a magenta toner image as a first color image on the photosensitive body 1. The toner image is transferred on an intermediate transfer belt 20*a* (FIG. 1) or an intermediate transfer drum 20*b* (FIG. 2) (hereinafter, referred to as "an intermediate transfer member 20*a* or 20*b*") rotating in a state being in contact with the photosensitive body 1. In this case, the transfer of the image from the photosensitive body 1 to the intermediate transfer member 20*a* or 20*b* is performed by applying a primary transfer bias from a power supply 61 to the intermediate transfer member 20*a* or 20*b* at a nip portion between the photosensitive body 1 and the intermediate transfer member 20*a* or 20*b*. After the magenta toner image as the first color image is transferred on the intermediate transfer member 20*a* or 20*b*, the surface of the photosensitive body 1 is cleaned using a cleaning device 14. The first development/transfer operation using the photosensitive body 1 is thus completed. Thereafter, the photosensitive body revolves on its axis three times, and a cyan toner image as a second color image, a yellow toner image as a third color image, and a black toner image as a fourth color image are sequentially formed on the photosensitive body 1 using developers 42, 43 and 44 for each revolution of the photosensitive body 1. The four toner images are sequentially transferred on the intermediate transfer member 20*a* or 20*b* in a superimposing manner for each revolution, to form a synthetic color toner image corresponding to the target color image on the intermediate transfer member 20*a* or 20*b*. It is to be noted that in the apparatus shown in FIG. 1, the developers 41 to 44 are sequentially exchanged for each revolution of the s photosensitive body 1 to sequentially perform development by the magenta toner M, cyan toner C, yellow toner Y, and black toner B.

Next, a transfer roller 25 is abutted on the intermediate transfer member 20*a* or 20*b* on which the above synthetic color toner image is formed, and a recording medium 24 such as a paper sheet is fed from a paper cassette 9 into a nip portion therebetween. At the same time, a second transfer bias is applied from a power supply 29 to the transfer roller 25 so that the synthetic color image is transferred from the intermediate transfer member 20*a* or 20*b* to the recording medium 24 and is thermally fixed thereon as the final image at state 15. After the synthetic color image is transferred to the recording medium 24, the toner remaining on the surface of the intermediate transfer member 20*a* or 20*b* is removed by the cleaning device 35, and thereby the intermediate transfer member 20*a* or 20*b* is returned to the initial state to ready for the next image formation.

In the image formation by such an intermediate transfer method, however, the transfer must be repeated twice, that is, the first transfer of a toner image from the photosensitive body 1 to the intermediate transfer member 20*a* or 20*b* and the second transfer of a toner image from the intermediate transfer member 20*a* or 20*b* to the recording medium 24 must be performed, as a result of which there may occur a problem, particularly, upon the second transfer of the toner image from the intermediate transfer member 20*a* or 20*b* to the recording medium 24. The reason is that, along with repeating of printing, toner is possibly stuck and fused on the intermediate transfer member 20*a* or 20*b*, leading to reduction in efficiency of transfer to the recording medium 24 or difficulty in accurately transferring a toner image from the photosensitive body 1 to the intermediate transfer member 20*a* or 20*b* due to the presence of the toner stuck on the intermediate transfer member 20*a* or 20*b*.

Here, in the image forming apparatus using the intermediate transfer belt 20*a* shown in FIG. 1, as shown in the figure, the intermediate transfer belt 20*a* is generally disposed between the photosensitive drum 1 and the recording medium 24 in a state being wound around a plurality of (four pieces in the figure) rotating rollers 5 including at least one drive roller, and is circularly driven by the drive roller. In this case, to prevent slip-off or positional offset of the intermediate transfer belt 20*a* from each rotating roller 5, as shown in FIG. 5, a projecting portion 51 continuously extending in the rotational direction of the belt is integrally formed on the back surface side of the intermediate transfer belt 20*a*. Thus, the intermediate transfer belt 20*a* is circularly driven in a state in which the projecting portion 51 is fitted in a recessed portion (not shown) circumferentially provided in the surface of the drive roller among the rotating rollers 5.

The intermediate transfer belt 20*a* used for the prior art intermediate transfer mechanism, however, exhibits, after use for a long-period of time, the following disadvantages:

(1) The intermediate transfer belt 20*a* may slip off from the rotating rollers 5 or offset in its rotating path due to wear, deformation or the like of the projecting portion 51, resulting in unevenness of color of the obtained image;

(2) The particles produced by wear of the projecting portion 51 may exert as adverse effect on the apparatus; and (3) The wear of the projecting portion 51 may cause noise during driving of the intermediate transfer belt 20*a*.

Incidentally, the intermediate transfer belt 20*a* used for the image forming apparatus in accordance with the intermediate transfer method is generally manufactured by winding a sheet made from a resin or rubber around the outer periphery of a cylindrical mold and vulcanizing the sheet.

The intermediate transfer belt thus manufactured in accordance with the prior art method, however, tends to cause a variation in peripheral length after vulcanizing/forming of the belt. In other words, the prior art method fails to stably obtain a belt being excellent in dimensional accuracy. Also, when the intermediate transfer belt manufactured by the prior art method is stretchingly wound around the rotating rollers 5 including the drive roller, there occurs a variation in elongation, which may obstruct normal rotation of the belt. Further, even if the belt can be normally rotated at the initial state after being stretchingly wound around the rollers, it is possibly elongated with an elapsed time, which may obstruct normal rotation of the belt.

SUMMARY OF THE INVENTION

An object of the present invention is to provide an intermediate transfer body capable of preventing adhesion and fusion of a toner on the surface thereof in the case of printing by an intermediate transfer method in an electrostatic recording process, thereby certainly obtaining a high quality image without dimming, positional offset or unevenness of color; to provide an intermediate transfer belt capable of certainly preventing occurrence of slip-off or offset of the intermediate transfer belt due to the performance of a fitting portion such as a projecting portion formed on the intermediate transfer belt in printing by the intermediate transfer method, thereby certainly obtaining a desirable image for a long-period of time and also reducing occurrence of noise during driving of the intermediate transfer belt; to provide a method of manufacturing the intermediate transfer belt, capable of reducing a variation in inner peripheral length of the intermediate transfer belt thereby improving the dimensional accuracy of the intermediate transfer belt, and reducing elongation at the initial state after being wound around rollers and during driving of the belt and also elongation with an elapsed time; and to provide an intermediate transfer device using the above intermediate transfer member.

The present inventor has earnestly studied to achieve the above object, and found that, in printing by the intermediate transfer method in which a toner image formed on an image forming body such as a latent image support is once transferred and held on the surface of an intermediate transfer member and is then transferred on a recording medium, the use of an intermediate transfer member including a fabric layer having a structure of one or more layers and an elastic layer laminated on either or each of surfaces of the fiber layer prevents adhesion and fusion of a toner as mush as possible, thereby certainly obtaining a high quality image without dimming, positional offset, and unevenness of color. The present invention has been accomplished on the basis of the above knowledge.

Accordingly, the present invention provides an intermediate transfer member, disposed between an image forming body and a recording medium, for allowing a toner image formed on the surface of the image forming body to be once transferred and held on the surface of the intermediate transfer member and to be then transferred on the recording medium, the intermediate transfer member including: a fabric layer having a structure of one or more layers; and an elastic layer laminated on either or each of surfaces of the fabric layer.

Also, the present inventor has found that, in the case of where the intermediate transfer member of the present invention, which is formed into a belt-shape and is provided with a fitting portion such as a projecting portion, is circularly driven in a state in which the fitting portion is fitted in a recessed portion or the like formed in a drive member, a configuration in which at least part of the fitting portion has a reinforcing layer made from a material different from that of the above elastic layer or the reinforcing layer is formed at a portion of the belt main body where the fitting portion is to be formed, effectively prevents wear and deformation of the fitting portion, thereby certainly preventing occurrence of slip-off or offset of the intermediate transfer belt and certainly obtaining a desirable image for a long-period of time and also effectively reducing occurrence of noise during driving of the intermediate transfer belt.

Accordingly, the present invention also provides an endless belt-shaped intermediate transfer member which is 115 disposed between an image forming body and a recording medium and circularly driven by a drive member for allowing a toner image formed on the surface of the image forming body to be once transferred and held on the surface of the intermediate transfer member and to be then transferred on the recording medium; wherein the endless belt shaped intermediate transfer member includes a belt main body having the fabric layer and the elastic layer laminated on either or each of surfaces of the fabric layer; and the belt main body has a fitting portion to be fitted with the drive member, the fitting portion being formed on or in a surface of the belt main body to be in contact with the drive member.

Further, the present inventor has found that, in manufacture of an intermediate transfer belt of the present invention, that is, a fabric-reinforced endless belt having an elastic layer made from a resin or a rubber, which is disposed between an image forming body and a recording medium and circularly driven by a drive member for allowing a toner image formed on the image forming body to be once transferred and held on the surface thereof and to be then transferred on the recording medium, by subjecting the endless belt to heat-treatment in a state in which the endless belt is extended, a variation in inner peripheral length of the belt is reduced, and the obtained belt is small in elongation at the initial state after being wound around rollers and during driving of the belt or elongation with an elapsed time, resulting in the stable operation of the belt.

Accordingly, the present invention provides a method of manufacturing an intermediate transfer belt, which is disposed between an image forming body and a recording medium and is circularly driven by a drive member for allowing a toner image formed on the surface of the image forming body to be once transferred and held on the surface of the endless belt and to be then transferred on the recording medium, the method including the step of: subjecting a fabric-reinforced endless belt having an elastic layer made from a resin or a rubber to heat-treatment in a state in which the endless belt is extended.

Further, the present invention provides an intermediate transfer device including: an intermediate transfer member disposed between an image forming body and a recording medium for allowing a toner image formed on the surface of the image forming body to be once transferred and held on the surface of the intermediate transfer body and to be then transferred on the recording medium; and a voltage applying means for applying a voltage on the intermediate transfer member; wherein the device uses the above intermediate transfer member such as the intermediate transfer belt or the intermediate transfer belt manufactured by the above manufacturing method.

In this case, the voltage applying means exchanges the polarities of the applied voltage between the transfer of a toner image from the image forming body such as a photosensitive drum or a belt to the intermediate transfer member and the transfer of the toner image from the intermediate transfer member to the recording medium such as a paper sheet, for achieving smooth transfer of the toner image.

BRIEF DESCRIPTION OF THE DRAWINGS

FIGS. 9A and 9B are views showing one example of an extended/contracted drum used for a method of manufacturing the intermediate transfer belt of the present invention, wherein FIG. 9A is a sectional view and FIG. 9B is a right side view.

DETAILED DESCRIPTION OF THE PREFERRED EMBODIMENTS

Hereinafter, the present invention will be described in detail with reference to the accompanying drawings.

Figure 1:
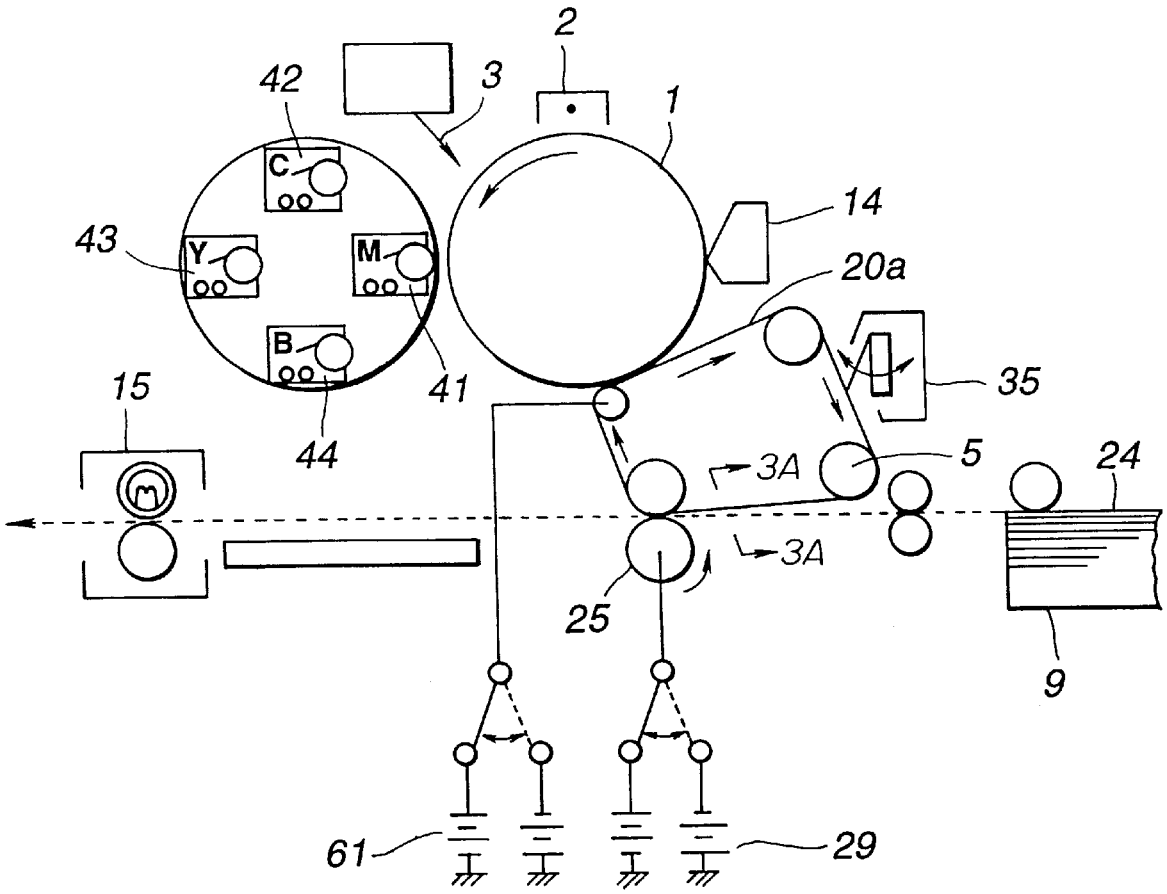
FIG. 1 is a schematic view showing one example of an intermediate transfer device using an intermediate transfer member of the present invention.

An intermediate transfer member of the present invention is formed, for example, into an endless belt, like an intermediate transfer belt indicated by reference numeral 20*a* in FIG. 1. The intermediate transfer belt 20*a*, which is disposed between a photosensitive drum (latent image support) 1 and a recording medium 24 such as a paper sheet, is circularly driven by rotating rollers 5 including a drive roller (drive member) for allowing a toner image formed on the surface of the photosensitive drum 1 to be once transferred and held on the surface of the intermediate transfer belt 20*a* and to be then transferred on the recording medium 24. It is to be noted that the apparatus shown in FIG. 1 is, as described above, used for color printing by the intermediate transfer method.

The intermediate transfer member of the present invention includes a fabric layer having a structure of one or more layers and an elastic layer laminated on either or both of surfaces of the fabric layer. For example, as shown in FIGS. 3A and 3B, two elastic layers 22 are laminated on both surfaces of a fabric layer 21, and further a resin layer 23 is formed on the surface of one elastic layer 22.

The fabric layer 21 may be formed of a known woven fabric or non-woven fabric. For example, there may be used woven fabrics and non-woven fabrics of natural fibers such as hemp, hair, silk and cotton; regenerated fibers such as viscose fibers; synthetic fibers such as fibers of polyester, nylon (for example, nylon 6, 66, 46), vinylon, vinylidene chloride, polyolefine (for example, polyethylene and polypropylene), and polyclar; semi-synthetic fibers such as acetate fibers; so-called high functional fibers such as fibers of aramid, polyvinyl alcohol, and polyacrylonitrile; and metal fibers such as fibers of stainless steel and other kinds of steel. The weave structure of the woven fabric may be suitably selected from plain weave, twill weave, stain weave, and a combination thereof. In particular, the woven fabric having the plain weave structure is preferably used in terms of solidity and profitability.

Figure 3A:
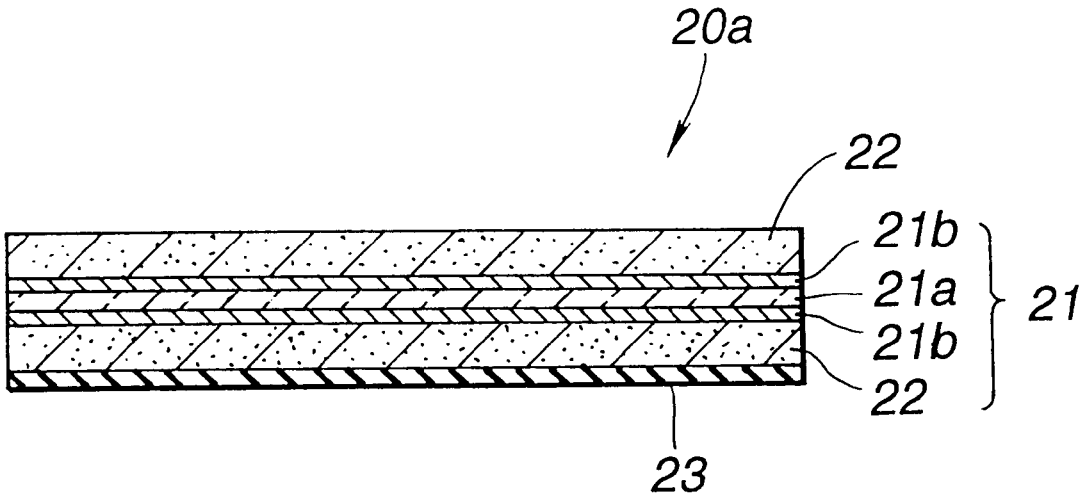
FIGS. 3A and 3B are enlarged sectional views taken on line A—A of FIG. 1, showing examples of the intermediate transfer member of the present invention.
Figure 3B:
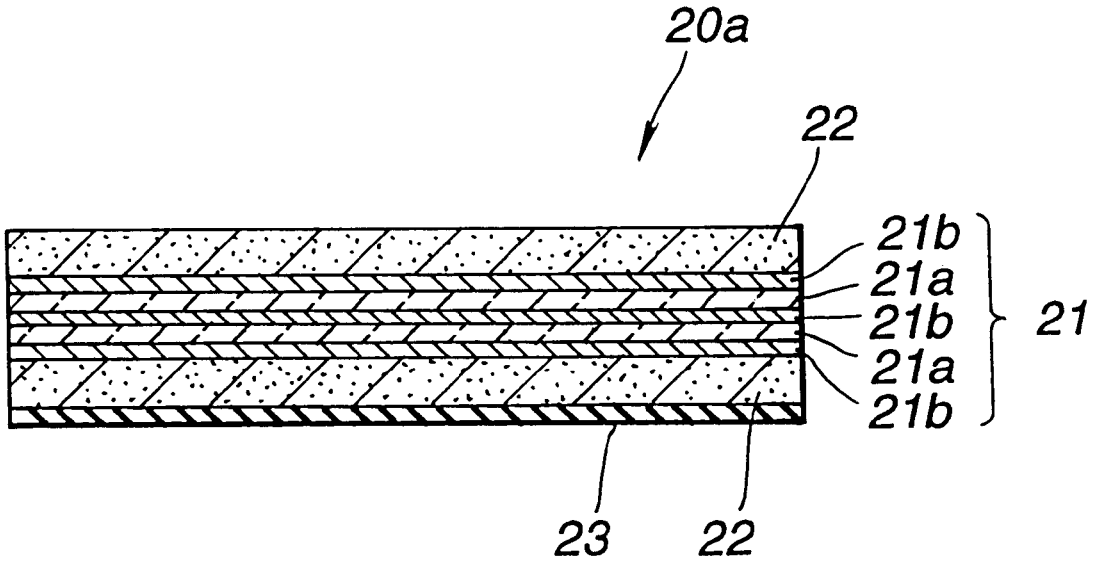

As shown in FIG. 3B, the fabric layer 21 may be of a multi-layer structure. In the example shown in the figure, the fabric layer 21 has two layers 21*a* formed of the above described woven fabric or non-woven fabric. The thickness of the fabric layer 21 is not particularly limited, but may be in a range of about 0.01 to 2 mm, preferably, in a range of about 0.05 to 0.5 mm. When the thickness of the fabric layer 21 is 0.01 mm or less, the dimensional stability due to the fabric layer 21 may be reduced, leading to deformation such as elongation of the intermediate transfer member 20*a*. When it is more than 2 mm, the flexibility of the intermediate transfer member 20*a* may be degraded. While not exclusively, the fiber diameter of the woven fabric or non-woven fabric forming the fabric layer 21 may be in a range of 20 to 420 denier, preferably, in a range of 30 to 210 denier, more preferably, in a range of 30 to 80 denier. Further, the thickness of the woven fabric or non-woven fabric may be, while not exclusively, set to be relatively small, for example, in a range of 0.01 to 0.2 mm, preferably, in a range of 0.05 to 0.15 mm. When the thickness is less than 0.01 mm, the dimensional stability due to the fabric layer 21 may be reduced, leading to deformation such as elongation of the intermediate transfer member 20*a*. When it is more than 0.2 mm, the flexibility of the intermediate transfer member 20*a* may be degraded.

Here, as shown by reference numeral 21*b* in FIGS. 3A and 3B, a surface portion or the whole of the woven fabric or non-woven fabric 21*a* forming the fabric layer 21 can be impregnated with a rubber or resin, if needed. This is effective to improve adhesiveness between the fabric layer 21 and the elastic layer 22 or resin layer 23 and the surface smoothness of the fabric layer 21. As the impregnant, there may be used a material similar to a material (which will be described in detail later) forming the elastic layer 22, which represented by a rubber cement, epoxy resin, resorcinform-aldehyde (RFL) resin, or a mixture thereof. The woven fabric or non-woven fabric 21*a* can be previously impregnated with such an impregnant by coating or dipping, to thus easily form an impregnated portion 21*b*.

The material for forming the elastic layer 22 is not particularly limited, and may include a resin such as polyurethane, rubber, and foam thereof. To be more specific, there may be used a general rubber such as nitrile rubber (NBR), chloroprene rubber (CR), isoprene rubber (IR), styrene-butadiene rubber (SBR), ethylene propylene rubber (EPDM), butyl rubber (IIR), natural rubber (NR), butadiene rubber (BR), acrylic rubber (ACR), or epichlorohydrin rubber (ECO); a thermoplastic rubber such as styrene-butadiene-styrene rubber (SBS) or a hydride thereof (SEBS); and a foam of the above rubber. In particular, a rubber composition of NBR or ECO added with NBR, BR and IR being low in viscosity is preferably used in terms of workability or hardness of the elastic layer 22. In this case, the composition may be in a range of [(NBR or NCO): (NBR+BR+IR)=(10–90): (90–10)] in weight percent based on the total weight of the rubber material of the elastic layer 22.

A conductive material can be added in the elastic layer 22 for giving a conductivity thereto or adjusting the conductivity thereof. Specific examples of the conductive materials may include, while not exclusively, a cationic surface active agent, for example, a quaternary ammonium salt such as a perchlorate, chlorate, borofluoride, sulfate, ethosulfate, benzyl halide (for example, benzyl bromide or benzyl chloride) of lauryl trimethylammonium, stearyl trimethylammonium, octadecyl trimethylammonium, dodecyl trimethylammonium, hexadecyl trimethylammonium, or modified fatty acid-dimethylethyl ammonium; an anionic surface active agent such as an aliphatic sulfonate, higher alcohol sulfate, higher alcohol sulfate added with ethylene oxide, or higher alcohol phosphate; an amphoteric surface active agent such as betaine; an anti-static agent, for example, a non-ionic anti-static agent such as higher alcohol ethylene oxide, polyethylenegrycol fatty acid ester, or polyhydric alcohol fatty acid ester; a salt of a group I metal such as $LiCF_2SO_2$, $NaClO_4$, $LiBF_4$ or NaCl; a salt of a group II metal such as $Ca(ClO_4)_2$; the above anti-static agent having one or more groups (hydroxy group, carboxyl group, primary or secondary amine group) containing active hydrogen reacting with isocyanate; an ionic conductor agent such as a complex of the above material and a polyhydric alcohol (1,4-butanediol, ethylene glycol, polyethylene glycol, propylene glycol or the like) or its derivative, or a complex of the above material and ethyleneglycol monomethylether, ethyleneglycol monoethylether or the like; conductive carbon such as ketchen black or acetylene black; rubber carbon such as SAF, ISAF, HAF, FEF, GPF, SRF, FT or MT; color ink carbon subjected to oxidation, pyrolytic carbon, natural graphite, or artificial graphite; metal and metal oxide such as tin oxide, titanium oxide, zinc oxide, nickel or copper; and a conductive polymer such as polyaniline, polypyrrole or polyacetylene.

The amount of the conductive material added to the elastic layer 22 may be in a range of 0.01 to 50 parts by weight, preferably, in a range of 0.1 to 30 parts by weight on the basis of 100 parts by weight of a resin or rubber component. By addition of the conductive material, the resistance of the elastic layer can be adjusted in a range of $10^2$ to $10^{14}$ Ωcm.

Figure 4A:
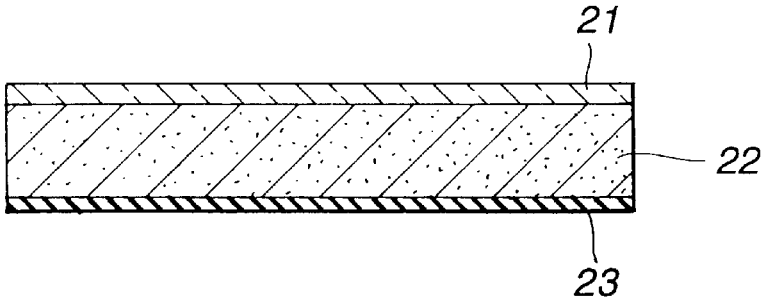
FIGS. 4A and 4B are enlarged sectional views taken on line A—A of FIG. 1, showing different examples of the intermediate transfer member of the present invention.
Figure 4B:
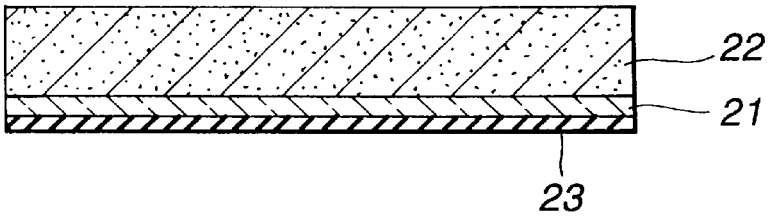

In the example shown in FIGS. 3A and 3B, the elastic layers 22 are provided on both surfaces of the fabric layer 21; however, as shown in FIG. 4A, the elastic layer 22 may be formed on one surface of the fabric layer 21 on the side to be in contact with or close to both the photosensitive drum 1 (latent image support) and the recording medium 24 and to be transferred with a toner image. Also, in the case where the resin layer 23 (which will be described in detail later) is formed on the toner image transfer surface of the fabric layer 21, as shown in FIG. 4B, the elastic layer 22 may be formed only on one surface on the side opposed to the toner image transfer surface of the fabric layer 21. Thus, the resin layer 23 can be formed on the fabric layer 21 to form the transfer surface. Also, while not shown, the fabric layers 21 may be laminated on both surfaces of the elastic layer 22 and the resin layer 23 may be formed on one fabric layer 21. The thickness of the elastic layer 22 (single layer) on one surface side may be suitably selected depending on the form of the intermediate transfer member. For example, in the case of the endless belt having the elastic layers 22 formed on both the surfaces of the fabric layer 21 as shown in FIGS. 3A and 3B, the thickness may be in a range of 0.01 to 2 mm, preferably, in a range of 0.05 to 0.5 mm.

The resin layer 23 may be made from a material which is, while not exclusively, one kind or two kinds or more selected from fluorocarbon resin, fluorocarbon rubber, polyamide, polyurethane, polyester, alkyd resin, melamine resin, phenol resin, epoxy resin, acrylic resin, acrylsilicone resin, acrylurethane resin, silicone resin, amino resin, urea resin and the like.

While not exclusively, a resin containing a fluorocarbon resin is preferably used for the resin layer 23. In this case, as the fluorocarbon resin, there may be used polytetrafluoroethylene, tetrafluoroethylene-perfluoroalkyl vinylether-copolymer, tetrafluoroethylene-hexafluoropropyrene-perfluoroalkylvinylether-copolymer, tetrafluoroethylene-ethylene-copolymer, polychlorotrifluoroethylene, chlorotrifluoroethylene-ethylenecopolymer, polyvinylidenefluoride, or polyvinylfluoride. The use of the fluorocarbon resin is effective to prevent adhesion and fusion of a toner.

A conductive material similar to that mixed in the elastic layer 22 may be, while not exclusively, mixed in the resin layer 23 for giving a suitable conductivity to the resin layer 23. The content of the conductive material is not particularly limited, but it may be suitably selected in accordance with a desired resistance. For example, the content of the conductive material may be selected in consideration of the fact that the suitable surface resistance of the intermediate transfer member of the present invention is in a range of $10^2$ to $10^{18}$ Ωcm, preferably, in a range of $10^5$ to $10^{18}$ cm in volume resistivity. In general, the content of the conductive material may be in a range of 0.001 to 80 parts by weight on the basis of 100 parts by weight of the resin component.

The resin layer 23 may be further added with an additive such as a thixotropy imparting agent or structural viscosity imparting agent in a suitable amount. The additive may be of an inorganic based type or organic based type. For example, there may be used a silica compound.

In addition, the thickness of the resin layer 23 is not particularly limited, but it may be in a range of about 1 to 100 μm, preferably, in a range of 5 to 60 μm.

As shown in FIGS. 3A and 3B and FIGS. 4A and 4B (which are sectional views taken on line A—A of FIG. 1), the resin layer 23 is formed on the surface of the elastic layer 22 on the side to be in contact with or close to both the photosensitive drum 1 (latent image support) and the recording medium 24 and to be transferred with the toner image. In the intermediate transfer member, however, the resin layer 23 is not necessarily provided, and in some cases, the resin layer 23 may be omitted and the toner image can be directly transferred and held on the elastic layer 22.

Further, in the case of provision of the resin layer 23, a different resin or rubber layer may be formed between the resin layer 23 and the elastic layer 22.

As the material of the above different resin or rubber layer, there may be used a rubber similar to that for forming the elastic layer 22, chlorinated polyethylene, chlorosulfonated polyethylene, polyester resin, acrylic resin, urethane resin, polydioxolan resin, urethane-modified acrylic resin, nylon resin, epoxy resin, styrene resin, polyvinylactal resin, fluorocarbon resin, or fluorocarbon rubber.

The same conductive material as that added in the elastic layer 22 may be added in the above different resin or rubber layer in a range of 0.01 to 50 parts by weight, preferably, in a range of 0.1 to 30 parts by weight on the basis of 100 parts by weight of the resin or rubber component. The volume resistivity of the different resin or rubber layer can be thus adjusted in a range of $10^2$ to $10^{14}$ Ωcm, preferably, in a range of $10^5$ to $10^{14}$ Ωcm. The thickness of the different resin or rubber layer is not particularly limited but may be generally in a range of 1 to 600 μm.

With respect to the intermediate transfer member of the present invention, the surface roughness (10 points-average roughness Rz specified under JIS) may be, while not exclusively, in a range of 10 μm, preferably, in a range of 6 μm or less, more preferably, in a range of 3 μm or less; and the volume resistivity may be, while not exclusively, in a range of about $10^6$ to $10^{14}$ Ωcm.

Figure 5:
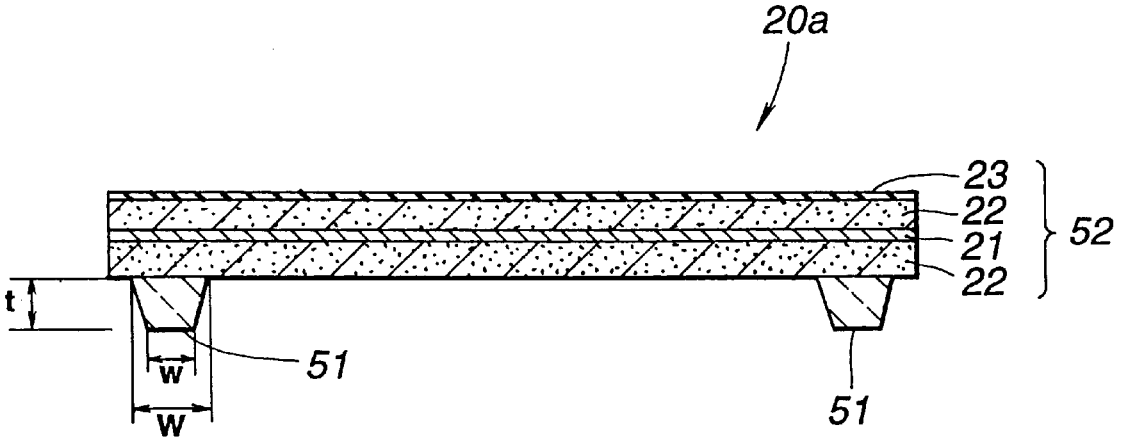
FIG. 5 is a sectional view showing one example of an intermediate transfer belt provided with a projecting portion (fitting portion)

Incidentally, in the case where the intermediate transfer member of the present invention is used as the belt-shaped intermediate transfer belt 20*a*, as shown in FIG. 1, it is wound around a plurality (four pieces in the figure) of the rotating rollers 5 including at least one drive roller (drive member) and is circularly driven by the drive roller (drive member). In this case, a fitting portion such as a projecting portion can be provided on the back surface of the belt in contact with each roller 5, and the intermediate transfer member can be stably circularly driven in a state in which the fitting portion is fitted in a recessed portion formed in the outer peripheral surface of each roller 5. For example, as shown in FIG. 5, two projecting portions 51 as projecting ribs continuously extending in the rotational direction of the belt can be provided at both side end portions on the back surface of a belt main body 52 having the fabric layer 21 and the elastic layers 22 laminated on both the surfaces of the fabric layer 21, and the intermediate transfer belt 20*a* can be circularly driven in a state in which the two projecting portions 51 are fitted in grooves provided in the outer peripheral surface of each roller 5 along the circumferential direction.

Here, while not exclusively, the projecting portion (fitting portion) 51 is preferably configured such that at least part thereof has a reinforcing layer made from a material different from that forming the elastic layer 22 or the projecting portion 51 is formed through a reinforcing layer made from a material different from that forming the elastic layer 22. This makes it possible to effectively prevent wear or deformation of the projecting portion 51, and hence to certainly prevent occurrence of slip-off and offset of the intermediate transfer belt. As a result, it is possible to certainly obtain a desirable image for a long-period of time and to effectively reduce occurrence of noise during driving of the belt.

The reinforcing layer is made from a material being superior in wear resistance to at least the elastic layer 22. The material of the reinforcing layer may include, while not exclusively, a composite material in which the resin, rubber or foam used for forming the elastic layer 22 is reinforced by reinforcing fibers; or a woven fabric or non-woven fabric.

As the above reinforcing fibers, there may be used fibers of glass, carbon, graphite, aramid, cotton, rayon, nylon, polyethylene, ceramics (for example, SiC, $Al_2O_3$), and metals (for example, boron, stainless steel). The content of the reinforcing fibers is suitably selected depending on the kind of the reinforcing fibers, and may be generally in a range of 5 to 70 wt % on the basis of the total amount of the reinforcing layer. As the reinforcing fibers, there may be used short-fibers, long-fibers or a combination thereof. The short-fiber generally has a length of about 2–10 mm.

The above woven fabric or non-woven fabric is, while not exclusively, may be similar to that used for forming the fabric layer 21 of the belt main body 52. That is, like the belt main body 52, a woven fabric having a plain weave structure made from fibers of polyester, nylon, polyolefine, or aramid is preferably used. The fiber diameter and the thickness may be similar to those in the case of the fabric layer 21 of the belt main body 52. That is, the fiber diameter is in a range of 20 to 100 denier, preferably, in a range of 30 to 80 denier; and the thickness is in a range of 0.01 to 0.2 mm, preferably, in a range of 0.05 to 0.15 mm. Additionally, like the fabric layer 21 of the belt main body 52, the woven fabric may be impregnated with a resin or rubber.

Figure 6A:
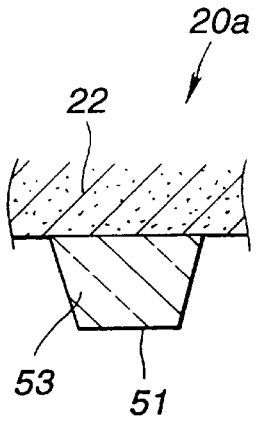
FIGS. 6A, 6B and 6C are partial enlarged sectional views showing examples of the projecting portion (fitting portion) of the present invention.
Figure 6B:
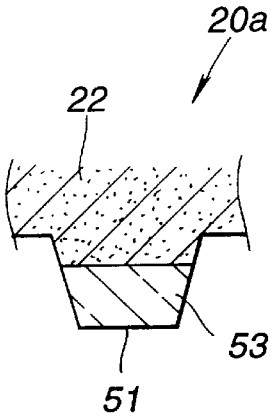
Figure 6C:
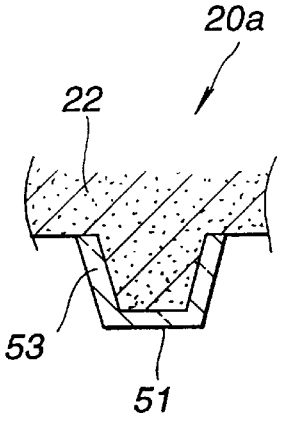
Figure 7A:
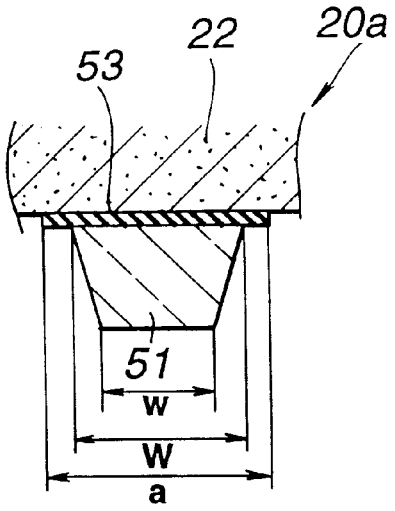
FIGS. 7A, 7B, 7C and 7D are partial enlarged sectional views showing different examples of the projecting portion (fitting portion) of the present invention.
Figure 7B:
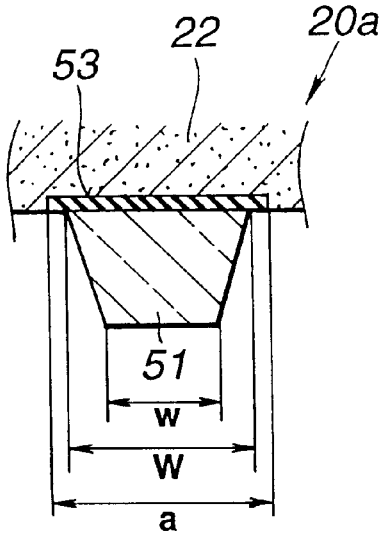
Figure 7C:
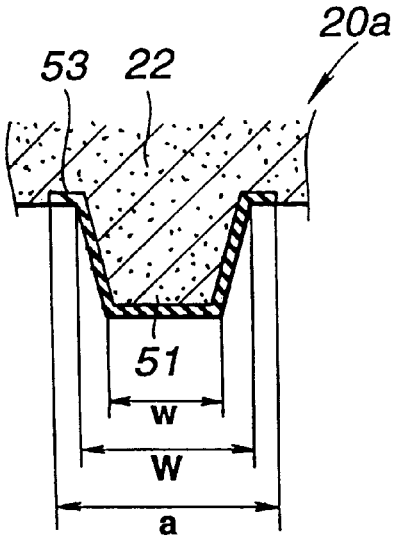
Figure 7D:
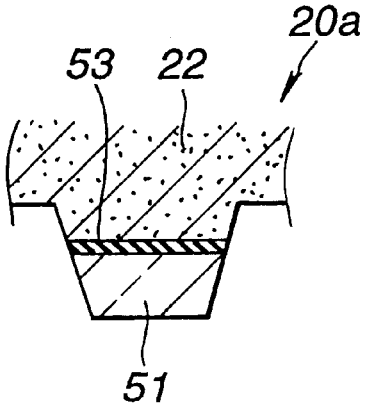

With respect to the projecting portion 51 as the fitting portion, at least part thereof may be formed of the above reinforcing layer, or the projecting portion may be provided on the belt main body 52 through the above reinforcing layer. For example, referring to FIGS. 6A, 6B and 6C, the entire projecting portion 51 may be formed of the reinforcing layer 53 (see FIG. 6A); only the leading end side of the projecting portion 51 may be formed of the reinforcing layer 53 (see FIG. 6B); and the surface of the projecting portion 51 is covered with the reinforcing layer 53 (see FIG. 6C). In particular, it is preferred that the entire projecting portion 51 be formed of the reinforcing layer 53 or the surface of the projecting portion 51 be covered with the reinforcing layer 53. In the case where the reinforcing layer 53 is composed of the fabric layer formed of a woven fabric or non-woven fabric, as shown in FIGS. 7A to 7D, the reinforcing layer 53 may be laminated on or buried in a portion of the elastic layer 22 where the projecting portion 51 is to be formed and the projecting portion 51 may be formed through the reinforcing layer 53 (see FIG. 7A or 7B). The projecting portion 51 may be reinforced by covering the surface thereof with the reinforcing layer 53 (see FIG. 7C) and the reinforcing layer 53 may be buried in the projecting portion 51 (see FIG. 7D).

Here, in the case where the projecting portion 51 is formed on the elastic layer 22 through the reinforcing layer 53 formed of the fabric layer (FIGS. 7A or 7B) or the surface of the projecting portion 51 is covered with the reinforcing layer 53 formed of the fabric layer (FIG. 7C), a width a of the reinforcing layer 53, while not exclusively, may be made wider than a base end width W of the projecting portion 51 insofar as it does not exert adverse effect on an image. A relationship between the width a and the width W is preferably set at $a=0.3\times W$ to $10\times W$.

The reinforcing layer 53 is provided for improving the wear resistance of the projecting portion (fitting portion) 51 and also preventing deformation of the projecting portion 51 and its neighborhood, thereby preventing slip-off and offset of the belt and also preventing occurrence of noise. However, if the hardness of the projecting portion 51 is excessively large, the flexibility of the belt is reduced, and in some arrangements, the belt wound around the rotating rollers 5 cannot be smoothly circularly driven. Consequently, while not exclusively, the hardness of the projecting portion (fitting portion) 51 may be adjusted to be higher about 2–20°, preferably about 5–10° in JIS-A scale than the hardness of the elastic layer 22.

As shown in FIG. 5, FIGS. 6A to 6C and FIGS. 7A to 7D, the projecting portion 51 is generally formed into a trapezoid shape in cross-section with the leading end width w being narrower than the base end width W (see FIG. 5); however, it can be suitable selected depending on the shape of the recessed portion provided in each rotating roller 5 to be fitted with the projecting portion 51. Although the projecting portion 51 is generally formed as a projecting rib continuously extending in the rotating direction of the belt, it is not limited thereto. For example, a number of projecting portions may be aligned in line along the rotational direction of the belt. Further, in the example shown in FIG. 5, the two projecting portions 51 are provided at both end portions of the belt. However, one or three or more of the projecting portions may be provided, and also the projecting portions may be provided at a central portion of the belt.

Figure 8:
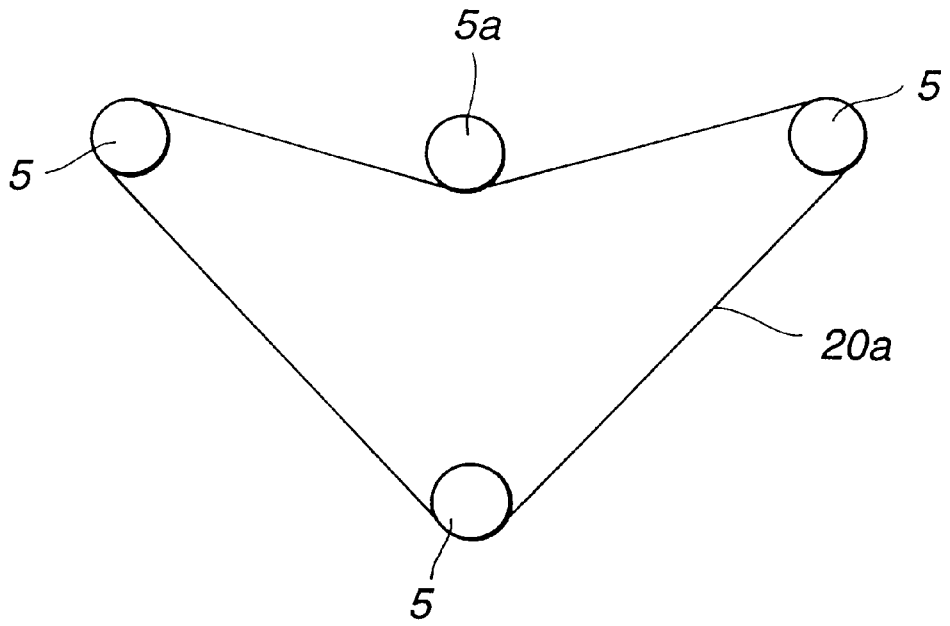
FIG. 8 is a schematic view showing one example of a mechanism for circularly driving an intermediate transfer belt.

In addition, although the above description is made by way of the example in which the intermediate transfer belt 20*a* is wound around four pieces of the rotating rollers 5 including at least one drive roller (drive member), there may be used another arrangement, for example, as shown in FIG. 8 in which, separately from three pieces of rotating rollers 5 around which the intermediate transfer belt 20*a* is wound, there is provided a drive roller 5*a* (drive member) abutted on the front surface side (toner image transfer surface) of the belt 20*a* for circularly driving the intermediate transfer belt 20*a*. In this case, on the surface side of the belt being in contact with the drive roller 5*a*, is formed a projecting portion (fitting portion) to be fitted in a recessed portion formed in a peripheral surface of the drive roller 5*a*. The fitting portion is not limited to the projecting portion but may be a recessed portion to be fitted with a projecting portion formed on the outer peripheral surface of the drive roller. Further, although the recessed portion as the fitting portion is generally formed of a groove continuously extending along the rotational direction of the belt. It may be formed of a number of small grooves aligned in line along the rotational direction of the belt in such a manner as to correspond to a number of projections aligned in line on the outer peripheral surface of the drive roller along the circumferential direction. The shape and the arrangement of the fitting portion of the intermediate transfer belt of the present invention may be changed without departing from the scope of the present invention.

The intermediate transfer member of the present invention can be manufactured by a known method, and the manufacturing method thereof is not limited; however, for the belt-shaped intermediate transfer member, it is preferred that the fabric-reinforced endless belt having the fabric layer 21 and the elastic layers 22 be manufactured by heat-treatment of the belt in a state in which the belt is extended. With this method, it is possible to reduce a variation in peripheral length of the belt and hence to obtain an intermediate transfer belt excellent in dimensional accuracy. Further, the belt thus obtained is small in elongation at the initial state after being stretchingly wound around the rollers and during driving of the belt and it is also small in elongation with an elapsed time. The endless belt obtained by the above method, therefore, enables stable operation for a long-period of time.

The endless belt can be easily formed by a usual method, for example, a method using a cylindrical mold. In the case of using a woven fabric or non-woven fabric as the reinforcing fibers, the endless belt can be manufactured by winding the woven fabric or non-woven fabric impregnated with the rubber cement around the outer periphery of the cylindrical mold, forming a sheet-like elastic layer on the woven fabric or non-woven fabric by extrusion-molding and laminating a different resin or rubber layer thereon if needed, vulcanizing and hardening the resultant sheet-like layers to obtain a belt, and forming the resin layer on the surface of the belt if needed. In the case where the elastic layers are formed on both the surfaces of the fabric layer, the first elastic layer is wound around the outer periphery of the cylindrical mold, the woven fabric or non-woven fabric is wound therearound, and the second elastic layer is wound therearound, followed by vulcanization thereof. In the case where the reinforcing fibers are incorporated in the elastic layer, the reinforcing fibers are uniformly mixed in a resin or rubber composition, and the mixture is extruded into a sheet-shape. The sheet thus obtained is then directly wound around the outer periphery of the cylindrical mold, followed by vulcanization thereof.

In this manufacturing method, the endless belt is subjected to heat-treatment in an extended state for improving the dimensional stability. In this case, the method of extending the endless belt is not particularly limited, but may be suitably selected. In particular, there is preferably adopted a method of using an extended/contracted drum capable of uniformly extending the endless belt over the entire periphery. To be more specific, the endless belt is wound around the outer periphery of the extended/contracted drum capable of being changed in its outer peripheral length; the extended/contracted drum is extended at a specific rate to extend the endless belt; and the endless belt is subjected to heat-treatment in such an extended state. The extended/contracted drum used for this method has a structure, for example, shown in FIGS. 9A and 9B.

Figure 9A:
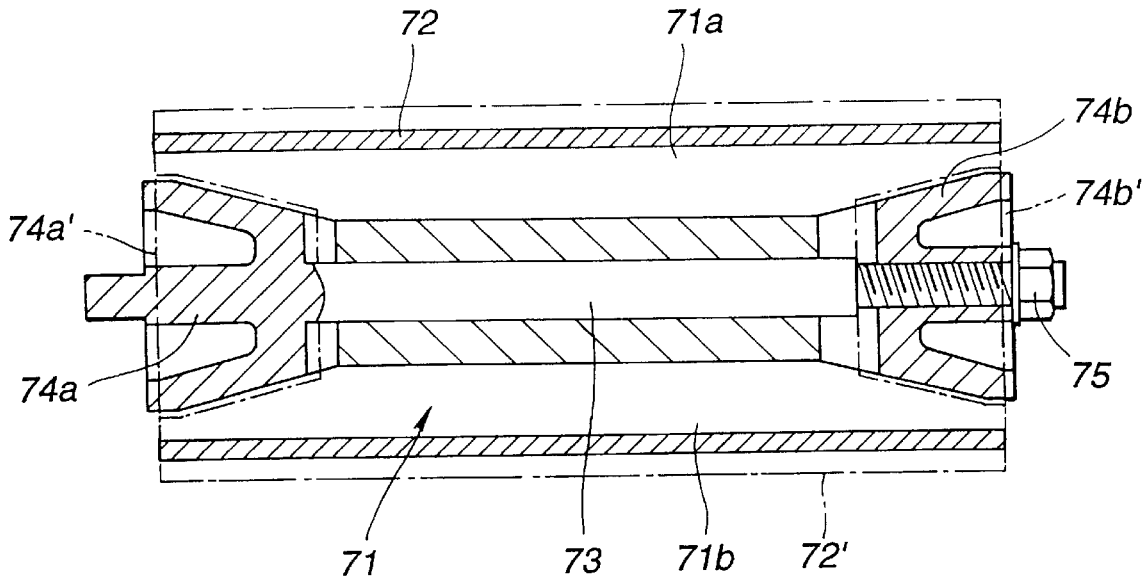
Figure 9B:
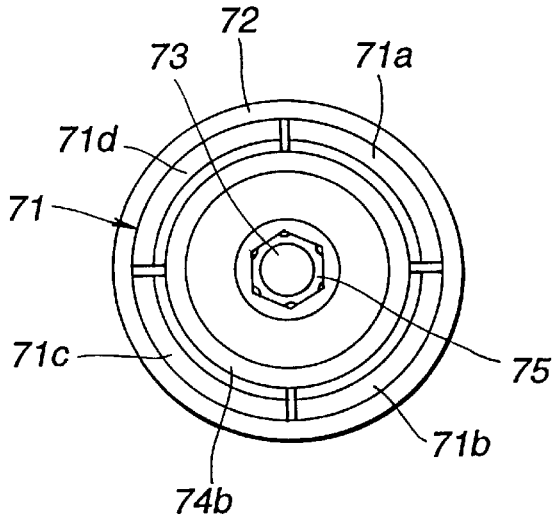

As shown in FIGS. 9A and 9B, the extended/contracted drum has an extended/contracted cylindrical body 71 divided into a plurality of (four pieces in the figures) divided parts 71*a*, 71*b*, 71*c* and 71*d* each being formed in an arcuate shape in cross-section, and an extensible urethane layer 72 provided to cover the outer periphery of the extended/contracted cylindrical body 71. The extended/contracted cylindrical body further has truncated cone-shaped extended/contracted pieces 74*a* and 74*b* which are inserted in both end portions of the extended/contracted cylindrical body 71. The extended/contracted pieces 74*a* and 74*b* are connected to each other with a bolt 73. Each of the inner peripheral surfaces of both the end portions of the extended/contracted cylindrical body 71 is tapered such that the diameter becomes gradually smaller toward the inner side. The base end of the bolt 73 is integrated with one extended/contracted piece 74*a* and the other end of the bolt 73 is threaded. The other end of the bolt 73 passes through the other extended/contracted piece 74*b* and is screwed with a nut 75, to connect both the extended/contracted pieces 74*a* and 74*b* to each other. Thus, as shown by dotted chain lines 74*a*' and 74*b*' of FIG. 9A, by fastening the nut 75, both the extended/contracted pieces 74*a* and 74*b* are moved in the direction where they are close to each other to be thus advanced in the extended/contracted cylindrical body 71. Consequently, as shown by a dotted chain line 72', the divided parts 71*a*, 71*b*, 71*c* and 71*d* are extended outward, to increase the outside diameter of the drum. Accordingly, by mounting the endless belt around the outer periphery of the extended/contracted cylindrical body and fastening the nut 75 to extend the diameter of the extended/contracted cylindrical body at a specific rate, the endless belt can be extended.

In the case where the endless belt is vulcanized/formed using the cylindrical mold, the resin or rubber of the elastic layer is contracted upon vulcanizing/forming of the belt, and after vulcanizing/forming of the belt, the endless belt in a state being mounted around the outer periphery of the cylindrical mold is left in a state being extended, so that the endless belt can be subjected to heat-treatment in a state being left mounted on the cylindrical mold after vulcanizing/forming of the belt without any operation for extending the belt.

Figure 10:
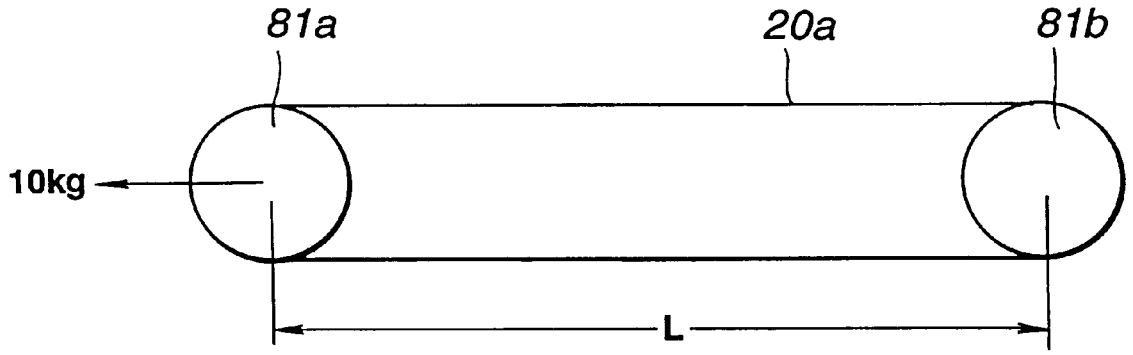
FIG. 10 is a schematic view illustrating a method of measuring the inner peripheral length of the belt.

Here, the extending rate of the endless belt upon heat-treatment is suitably selected in accordance with the kind of the material of the elastic layer and the kind and shape of the reinforcing fibers, and is not particularly limited. However, it may be in a range of 0.1 to 10%, preferably, in a range of 0.1 to 5% with a center distance L shown in FIG. 10 being taken as the reference inner peripheral length of the endless belt. In this case, the endless belt in a state being left mounted around the outer periphery of the cylindrical mold after vulcanizing/forming of the belt, generally, has an extending ratio of 0.1 to 0.5%. In addition, as shown in FIG. 10, the center distance L as the reference inner peripheral length of the endless belt is a length between centers of both shafts 81*a* and 81*b* in a state in which the endless belt 20*a* is wound around a pair of the shafts 80*a* and 80*b* and the shaft 81*a* is fixed while the shaft 81*b* is pulled separately from the shaft 81*a* with a force of 10 kg.

According to this manufacturing method, the endless belt is, as described above, subjected to heat-treatment in a state being extended. In this case, the heat-treatment condition may be suitably selected in accordance with the kind of the material for forming the elastic layer, the kind and shape of the reinforcing fibers, and the presence or absence of the different resin or rubber layer or the kind thereof, and is not particularly limited. However, it may be generally selected at a condition of 100–180° C.×5–30 min, preferably, 120–160° C.×10–20 min. In the case where the resin layer is formed, the resin layer coated on the endless belt can be dried by above heat-treatment in the state in which the belt is extended.

For the intermediate transfer member of the present invention formed into the endless belt shaped, as shown by the apparatus in FIG. 1, a voltage can be applied from a suitable power supply 61 to the drive roller or drive gear for rotating the intermediate transfer member 20*a*. In this case, the condition of applying the voltage can be suitably selected. For example, only DC voltage may be applied or DC voltage may be applied in a state it is superimposed with AC voltage.

Figure 2:
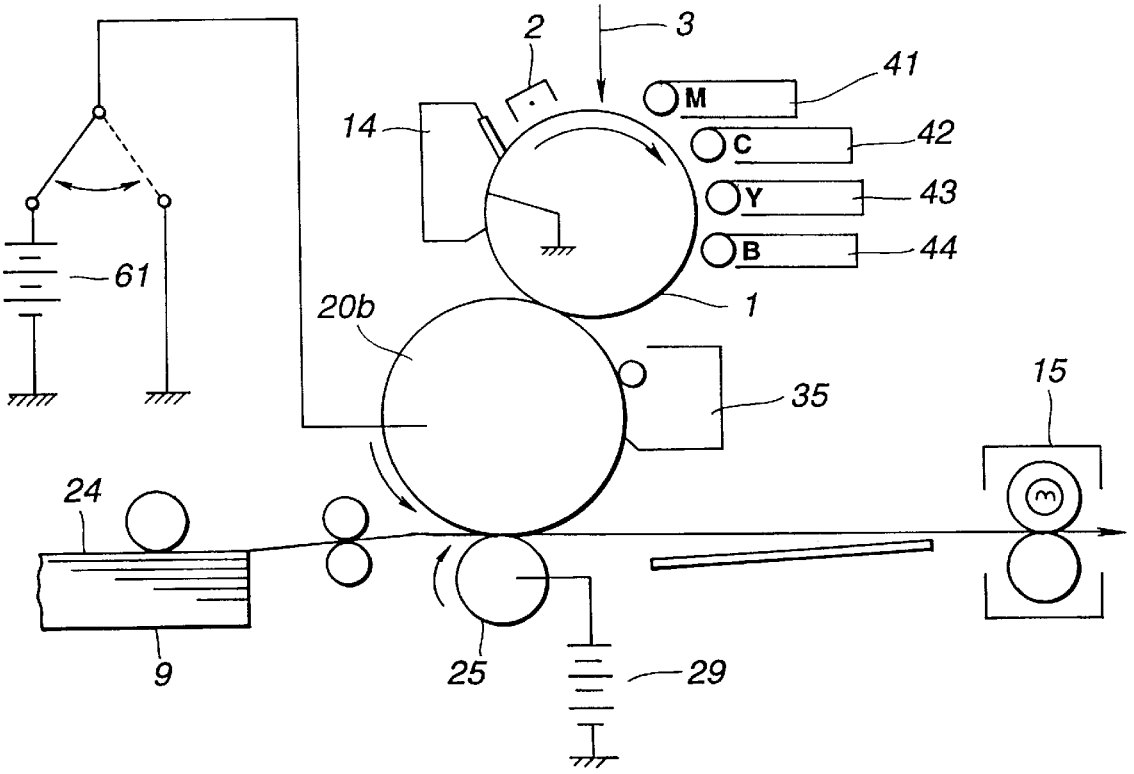
FIG. 2 is a schematic view showing another example of the intermediate transfer device using the intermediate transfer member of the present invention.

It should be noted that the form of the intermediate transfer member of the present invention is not limited to the endless belt shape shown in FIG. 1, FIGS. 3A and 3B, and FIGS. 4A and 4B, and it may be formed into a different shape insofar as it can be stably brought in contact with or close to an image forming body such as a photosensitive body. For example, it may be formed into a drum shape using a suitable base, like the intermediate transfer member 20*b* shown in FIG. 2. Further, the intermediate transfer device using the intermediate transfer member of the present invention is not limited to those shown FIGS. 1 and 2, and it should be understood that many changes may be made without departing from the scope of the present invention.

EXAMPLE

The present invention will be more clearly understood by way of the following inventive examples and comparative examples. It should be noted that the present invention is not limited to the following examples.

Example 1

A woven fabric (thickness: 0.1 mm) formed by plain weaving of polyester fibers having a fiber diameter of 50 denier was impregnated with a rubber cement (epichlorohydrin rubber). Two pieces of the woven fabric were laminated to each other, to form a fabric layer, and elastic layers 22 (thickness of each layer: 0.3 mm) made from a rubber composition shown in Table 1 were formed on both surfaces of the fabric layer. Thus, an endless belt shaped intermediate transfer member similar to that shown in FIG. 3B except for provision of no resin layer 23 was obtained. The volume resistivity of the elastic layer 22 was $3\times10^{9}$ Ωcm, and the volume resistivity of the entire member was $6\times10^{9}$ Ωcm.

TABLE 1

| compounding agent | compounding ratio (phr) |
|---|---|
| ECO | 80 |
| liquid NBR | 20 |
| zinc stearate | 1 |
| calcium carbonate | 20 |
| carbon SRF | 20 |
| vulcanizing agent P. O | 3 |

The intermediate transfer member thus obtained was then mounted as an intermediate transfer belt 20*a* in a color printer having the same mechanism as that shown in FIG. 1. Using this printer, 10,000 pieces of paper sheets were continuously printed. The images printed on the paper sheets were examined. As a result, it was found that the images were desirably printed on all of the paper sheets without occurrence of any inconvenience. The intermediate transfer member was removed from the printer after testing, and the surface state thereof was examined. As a result, with respect to the intermediate transfer member, adhesion of a tone on the surface was little observed and also abnormal deformation of the surface was not observed.

Example 2

The endless belt was prepared in the same manner as in Example 1, and a resin layer A (thickness: 40 μm) was formed on the surface of the elastic layer of the endless belt. An endless belt shaped intermediate transfer member similar to that shown in FIG. 3B was thus obtained. In this case, the resin layer A was formed by coating a paint containing 100 parts by weight of a soluble fluorocarbon resin and 25 parts by weight of an isocyanate type hardening agent on the surface of the elastic layer. The volume resistivity of the resin layer A was $3\times10^{13}$ Ωcm, and the volume resistivity of the entire member was $4\times10^{11}$ Ωcm.

Using the printer in which the intermediate transfer member thus obtained was mounted, paper sheets were printed in the same manner as in Example 1. As a result, it was found that the images were desirably printed on all of the paper sheets without occurrence of any inconvenience. The intermediate transfer member was removed from the printer after testing, and the surface state thereof was examined. As a result, with respect to the intermediate transfer member, adhesion of a tone on the surface was little observed and also abnormal deformation of the surface was not observed.

Example 3

The endless belt was prepared in the same manner as in Example 1, and a rubber layer (thickness: 40 μm) was formed on the surface of the elastic layer of the endless belt and further the same resin layer A (thickness: 40 μm) as that used in Example 2 was formed thereon. Thus, an endless belt shaped intermediate transfer member similar to that shown in FIG. 3B except for provision of the intermediate layer between the elastic layer 22 and the resin layer 23 was obtained. In this case, the rubber layer B was formed by coating a paint containing 100 parts by weight of a fluorocarbon rubber, 7 parts by weight of a polyol component, and 15 parts by weight of magnesium oxide. The volume resistivity of the rubber layer B was $1\times10^{13}$ Ωcm, and the volume resistivity of the entire member was $5\times10^{12}$ Ωcm.

Using the printer in which the intermediate transfer member thus obtained was mounted, paper sheets were printed in the same manner as in Example 1. As a result, it was found that the images were desirably printed on all of the paper sheets without occurrence of any inconvenience. The intermediate transfer member was removed from the printer after testing, and the surface state thereof was examined. As a result, with respect to the intermediate transfer member, adhesion of a tone on the surface was little observed and also abnormal deformation of the surface was not observed.

Comparative Example 1

An endless belt shaped transfer member having only the elastic layer (thickness: 0.8 mm), which was the same as that in Example 1 except for provision of no fabric layer, was obtained. The volume resistivity of the member was $3\times10^{9}$ Ωcm.

Using the printer in which the intermediate transfer member thus obtained was mounted, paper sheets were printed in the same manner as in Example 1. As a result, it was found that after printing of about 1,000 pieces of the paper sheets, the image become undesirable because of occurrence of unevenness of color and/or positional offset.

Comparative Example 2

An endless belt shaped transfer member in which the resin layer A (thickness: 40 μm) was formed on the surface of the elastic layer (thickness: 0.8 mm), which was the same as that in Example 2 except for provision of no fabric layer, was obtained. The volume resistivity of the member was $2\times10^{11}$ Ωcm.

Using the printer in which the intermediate transfer member thus obtained was mounted, paper sheets were printed in the same manner as in Example 1. As a result, it was found that after printing of about 1,800 pieces of the paper sheets, the image become undesirable because of occurrence of unevenness of color and/or positional offset. The intermediate transfer member was removed from the printer after testing, and the surface state thereof was examined. As a result, it was observed that part of the resin layer was cracked.

Example 4

An endless belt was prepared in the same manner as in Example 2, and projecting portions were formed on the back surface, that is, on the elastic layer of the endless belt at both end portions thereof. The projecting portion was formed in a truncated cone shape having a height t of 2 mm, base end width W of 5 mm, and a leading end width w of 2 mm (see FIG. 5 regarding the height t, base end width W, and leading end width w), and it was made from a material having the following composition. Thus, an intermediate transfer belt (peripheral length ϕ: 120 mm, width: 250 mm) having the same configuration as that shown in FIG. 5 was obtained.

Composition of Projecting Portion

The composition is the same as that of the material used for the elastic layer except for addition of 30 wt % of short-fibers of cotton.

The intermediate transfer belt thus obtained was wound around two pieces of rotating roller (one being a drive roller) in a state in which each projecting portion was fitted in a recessed portion formed in the surface of each roller, and was subjected to running test by circularly driving the belt with a belt tension of 5 kg at a speed of 100 mm/sec. As a result, there were observed no slip-off and no positional offset and also little noise after an elapse of 1,000 hours.

The above intermediate transfer member was mounted in a color printer having the same mechanism as that shown in FIG. 1. Using this printer, 4,000 pieces of paper sheets was continuously printed. As a result, it was found that the images were desirably printed on all of the paper sheets.

Example 5

An endless belt was prepared in the same manner as in Example 2. A woven fabric formed by plain weaving of polyester fibers was laminated on each portion of the elastic layer to be formed with a projecting portion, to thus form a reinforcing layer formed of the fabric layer on part of the elastic layer. Then, the projecting portions being the same as those in Example 4 were formed on the reinforcing layer. Thus, an intermediate transfer belt having the projecting portions having the same configuration as that shown in FIG. 7A was obtained. In addition, a width a of the reinforcing layer (see FIG. 7A) was 5 mm.

The intermediate transfer belt thus obtained was subjected to the same running test as that in Example 4, which gave a result that there was observed no slip-off and no positional offset and also little noise after an elapse of 1,000 hours. The intermediate transfer member was then subjected to the same printing test as that in Example 4, which gave a result that the images were desirably printed on all of the paper sheets.

Comparative Example 3

An elastic layer (thickness: 0.3 mm) having the following composition was prepared, and projecting portions were formed on the back surface of the elastic layer at both end portions. The projecting portion was made from a material having the same composition as that of the elastic layer, and was formed in a truncated cone shape in cross-section having a height t of 2 mm, base end width W of 5 mm and leading end width of 2 mm (see FIG. 5 regarding the height t, base end width W and leading end width w). A resin layer (thickness: 20 $\mu$m) having the same composition as that of the resin layer in Example 2 was formed on the surface of the elastic layer. Thus, an intermediate transfer belt (peripheral length $\phi$: 120 mm, width: 250 mm) was obtained.

| Composition of Elastic Layer | |
|---|---|
| ECO | 80 parts by weight |
| liquid NBR | 12 |
| zinc stearate | 2 |
| calcium carbonate | 20 |
| carbon SRF | 20 |
| vulcanizing agent P. O | 3 |

The intermediate transfer belt thus obtained was subjected to the same running test as in Example 4, which gave a result that after an elapse of 600 hours, the belt was slipped off from the rotating rollers due to wear of the projecting portions, and after elapse of 300 hours, noise occurred. The intermediate transfer member was then subjected to the same printing test as that in Example 4, which gave a result that after printing of 2,000 pieces of paper sheets, unevenness of color occurred.

Example 6

A woven fabric (thickness: 0.1 mm) formed by plain weaving of polyester fibers having a fiber diameter of 50 denier was prepared, and was impregnated with a rubber cement (epichlorohydrin rubber). Two pieces of the woven fabric were then laminated to each other to form a sheet-like fiber layer. The fabric layer and a rubber sheet formed by extrusion of a rubber composition shown in Table 1 were wound around the outer periphery of a cylindrical mold having an outside diameter of 146 mm, followed by vulcanizing/forming of the belt, and released from the cylindrical mold. Then, elastic layers were formed on both surfaces of the fiber layer, to form an endless belt.

The elastic layer of the endless belt thus obtained was coated with a paint containing 100 parts by weight of a soluble fluorocarbon resin and 25 parts by weight of an isocyanate type hardening agent, to form a resin layer having a thickness of 40 $\mu$m. The endless belt was then mounted around an extended/contracted cylindrical body with an outside diameter being changed into 150 mm upon expansion (outer peripheral length: 471.2 mm), followed by heat-treatment at 130° C. for 15 min to dry the resin layer, and removed from the extended/contracted cylindrical body, to thereby obtain an intermediate transfer belt.

Then, thirty pieces of the intermediate transfer belts thus obtained were examined in terms of inner peripheral length (mm) in the manner shown in FIG. 10, to obtain an average value (X) and a variation ($\sigma$) of the inner peripheral length. Further, in the manner shown in FIG. 10, the force applied to the shaft 81*a* was increased from 10 kg to 20 kg, and the elongation ratio (%) was measured to obtain an average value (X) and a variation ($\sigma$) of the elongation ratio (%). The results are shown in Table 2.

Example 7

An endless belt was prepared in the same manner as in Example 6, and the elastic layer of the endless belt was coated with a paint containing 100 parts by weight of a fluorocarbon rubber, 7 parts by weight of a polyol component, and 15 parts by weight of magnesium oxide, to form a rubber layer having a thickness of 20 to 40 $\mu$m, and then coated with a paint containing 100 parts by weight of a soluble fluorocarbon resin and 25 parts by weight of an isocyanate type hardening agent to form a resin layer having a thickness of 40 $\mu$m. Then, the endless belt was subjected to heat treatment in an extended state as in Example 6 to dry the resin layer. An intermediate transfer belt was thus obtained.

Then, thirty pieces of the intermediate transfer belts thus obtained were examined in terms of inner peripheral length (mm) in the same manner as in Example 6, to obtain an average value (X) and a variation ($\sigma$) of the inner peripheral length, and an average value (X) and a variation ($\sigma$) of the elongation ratio (%). The results are shown in Table 2.

Example 8

An endless belt was prepared in the same manner as in Example 6, and in a state in which the endless belt was not removed from the cylindrical mold and was left mounted around the outer periphery of the cylindrical mold, the same resin layer as that in Example 6 was formed and dried by heating, to thereby obtain an intermediate transfer belt.

Then, thirty pieces of the intermediate transfer belts thus obtained were examined, like Example 6, in terms of inner peripheral length (mm), to obtain an average value (X) and a variation (a) of the inner peripheral length, and an average value (X) and a variation (σ) of the elongation ratio (%).

The results are shown in Table 2.

Reference Example

Using a cylindrical mold having an outside diameter of 149.9 mm (outer peripheral length: 470.9 mm), an endless belt was vulcanized/formed in the same manner as in Example 6, and was released from the cylindrical mold. Then, the same resin layer as that in Example 6 was formed and was dried by heating in a state being not extended, to thereby obtain an intermediate transfer belt.

Then, thirty pieces of the intermediate transfer belts thus obtained were examined, like Example 6, in terms of inner peripheral length (mm), to obtain an average value (X) and a variation (σ) of the inner peripheral length, and an average value (X) and a variation (σ) of the elongation ratio (%). The results are shown in Table 2.

TABLE 2

| | | Example | | | Reference |
|---|---|---|---|---|---|
| | | 6 | 7 | 8 | Example |
| inner peripehral length | X (mm) | 470.54 | 470.49 | 470.46 | 470.50 |
| | σ | 0.15 | 0.18 | 0.23 | 0.97 |
| elongation | X (%) | 0.38 | 0.32 | 0.42 | 0.74 |
| | σ | 0.017 | 0.019 | 0.030 | 0.068 |

As shown in Table 2, each of the intermediate transfer belts obtained in Examples 6, 7 and 8 was small in a variation in inner peripheral length. Accordingly, it becomes apparent that an intermediate transfer belt excellent in dimensional accuracy can be obtained by the method of the present invention. Further, each of the intermediate transfer belts obtained in Examples 6, 7 and 8 was small in elongation ratio and its variation. As a result, it becomes apparent that the intermediate transfer belt of the present invention enables stable operation with less inconvenience due to elongation at the initial state after being wound around the rollers and during driving of the belt or elongation with an elapsed time.

What is claimed is:

1. An intermediate transfer member, disposed between an image forming body and a recording medium, for allowing a toner image formed on the surface of the image forming body to be transferred and held on a surface of said intermediate transfer member and then transferred on said recording medium, said intermediate transfer member comprising:

a fabric layer having a structure of one or more layers; and an elastic layer laminated on either or each of surfaces of said fabric layer, to form a transfer surface of said elastic layer.

2. An intermediate transfer member according to claim 1, wherein the thickness of said fabric layer is in a range of 0.01 to 2 mm.

3. An intermediate transfer member according to claim 1, wherein said fabric layer is formed of a woven fabric.

4. An intermediate transfer member according to claim 3, wherein said woven fabric has a plain weave structure, a twill weave structure, a stain weave structure, or a combination thereof.

5. An intermediate transfer member according to claim 3, wherein the thickness of said woven fabric is in a range of 0.01 to 0.2 mm.

6. An intermediate transfer member according to claim 3, wherein said woven fabric is impregnated with a rubber or resin.

7. An intermediate transfer member according to claim 1, wherein said elastic layer is formed of a rubber composition containing nitrile rubber or epichlorohydrin rubber.

8. An intermediate transfer member according to claim 1, wherein a resin layer is formed on the surface of said intermediate transfer member, to form the transfer surface of the resin layer.

9. An intermediate transfer member according to claim 8, wherein said resin layer contains a fluorocarbon region.

10. An intermediate transfer member according to claim 1, wherein said intermediate transfer member is formed into a belt-shape.

11. An intermediate transfer member according to claim 10, wherein said intermediate transfer member is an endless belt-shaped intermediate transfer member which is disposed between an image forming body and a recording medium and circularly driven by a drive member for allowing a toner image formed on the surface of said image forming body to be once transferred and held on the surface of said intermediate transfer member and to be then transferred on said recording medium;

said endless belt shaped intermediate transfer member includes a belt main body having said fabric layer and said elastic layer laminated on either or each of surfaces of said fabric layer; and said belt main body has a fitting portion to be fitted with said drive member, said fitting portion being formed on or in a surface of said belt main body to be in contact with said drive member.

12. An intermediate transfer member according to claim 11, wherein at least part of said fitting portion or a portion of said belt main body on which said fitting portion is to be formed has a reinforcing layer made from a material different from said elastic layer of said belt main body.

13. An intermediate transfer member according to claim 12, wherein said reinforcing layer is made from a material selected from a resin, a rubber, and a foam, or said material added with reinforcing fibers.

14. An intermediate transfer member according to claim 12, wherein said reinforcing layer is a fabric layer.

15. An intermediate transfer member according to claim 12, wherein said fitting portion is a projecting portion.

16. An intermediate transfer member according to claim 15, wherein said projecting portion is a projecting rib continuously extending along the rotational direction of said belt.

17. An intermediate transfer member according to claim 1, wherein elastic layers are laminated on both surfaces of the fabric layer, and further the resin layer is formed on the surface of one elastic layer, thereby to form the transfer surface of the resin layer.

18. An intermediate transfer device comprising:

an intermediate transfer member, disposed between an image forming body and a recording medium, for allowing a toner image formed on the surface of said image forming body to be once transferred and held on the surface of said intermediate transfer body and to be then transferred on the surface of said recording medium; and a voltage applying means for applying a voltage on said intermediate transfer member;

wherein said intermediate transfer device uses said intermediate transfer member comprising:

a fabric layer having a structure of one or more layers; and an elastic layer laminated on either or each of surfaces of said fabric layer.

19. An intermediate transfer device comprising:

a belt-shaped intermediate transfer member, disposed between an image forming body and a recording medium and circularly driven by a drive member, for allowing a toner image formed on the surface of said image forming body to be once transferred and held on the surface of said belt-shaped intermediate transfer member and to be then transferred on said recording medium; and a voltage applying means for applying a voltage to said belt-shaped intermediate transfer member;

wherein said intermediate transfer device uses said intermediate transfer member comprising:

a fabric layer having a structure of one or more layers; and an elastic layer laminated on either or each of surfaces of said fabric layer.

* * * * *